United States Patent [19]

Cordiano et al.

[11] Patent Number: 4,799,869

[45] Date of Patent: Jan. 24, 1989

[54] PNEUMATIC VANE PUMPS WITH OIL SEPARATION

[75] Inventors: Ettore Cordiano, Turin; Pierino Garnero, Rosta; Domenico Frigo, Vicenza, all of Italy

[73] Assignees: CORINT S.r.l.; GARRIG 4 S.s., both of Italy

[21] Appl. No.: 178,789

[22] Filed: Mar. 28, 1988

Related U.S. Application Data

[62] Division of Ser. No. 24,189, Mar. 10, 1987, abandoned.

[30] Foreign Application Priority Data

Mar. 10, 1986 [IT] Italy ..... 67188 A/86
Feb. 2, 1987 [IT] Italy ..... 67065 A/87

[51] Int. Cl.[4] ..... F04C 29/02

[52] U.S. Cl. ..... 418/97; 418/DIG. 1; 418/86; 55/248

[58] Field of Search ..... 418/86, 100, DIG. 1, 418/96, 97, 90, 259, 179; 55/438, 442

[56] References Cited

U.S. PATENT DOCUMENTS

| | | | |
|---|---|---|---|
| 3,217,977 | 11/1965 | Burger | 418/96 X |
| 3,314,599 | 4/1967 | Rollinger et al. | 418/DIG. 1 X |
| 3,669,579 | 6/1972 | Carter | 418/96 |
| 4,441,871 | 4/1984 | Boller | 418/DIG. 1 |

FOREIGN PATENT DOCUMENTS

| | | | |
|---|---|---|---|
| 2822780 | 12/1978 | Fed. Rep. of Germany | 418/97 |
| 1327273 | 4/1963 | France | 418/96 |
| 0108895 | 6/1984 | Japan | 418/97 |
| 0101292 | 6/1985 | Japan | 418/DIG. 1 |
| 530993 | 12/1940 | United Kingdom | 418/86 |

*Primary Examiner*—John J. Vrablik
*Assistant Examiner*—Leonard P. Walnoha
*Attorney, Agent, or Firm*—Sughrue, Mion, Zinn, Macpeak, and Seas

[57] ABSTRACT

An intermittently operating pneumatic vane pump has a cylindrical seat for its rotor constituted by a ring of porous sintered material housed in a container. The lubricating oil is collected in an interspace between the ring and the container when the pump is operating and returns to the pump when the pump is stopped, to keep the ring of the seat impregnated.

2 Claims, 5 Drawing Sheets

PNEUMATIC VANE PUMPS WITH OIL SEPARATION

Figure 1:
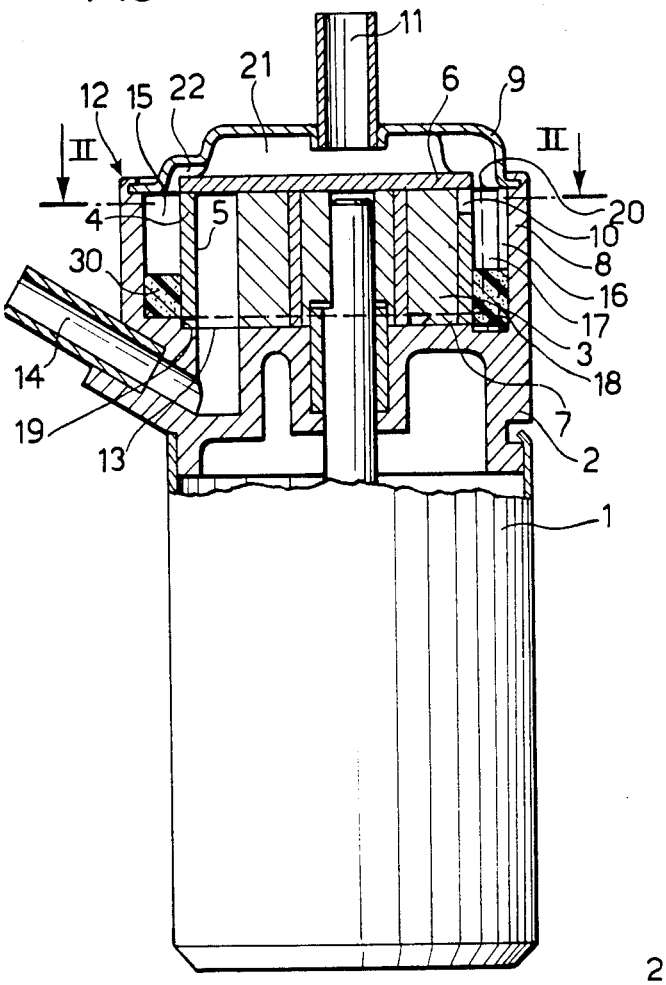

This is a division of application Ser. No. 024,189, filed Mar. 10, 1987, now abandoned.

The present invention relates to a pneumatic vane pump with intermittent lubrication and operation, of the type constituted by:

a rotor having recesses in which the vanes are housed, a cylindrical seat in which the rotor rotates, an electric driving motor, and assembled such that, when the pump is stopped, a limited quantity of oil is contained within the pump itself while, when the pump rotates, the oil is expelled from the pump, separated from the air and collected in a space inserted in the outlet pipe from the pump, and re-enters the pump from this space when the pump is stopped. A pump operating in accordance with this principle constitutes the subject of Italian patent application No. IT-A-0 067697 and the corresponding European patent application B No. EP-A-0 210145.

The object of the present invention is to reduce the cost and improve the operation of such a device. This object is achieved by means of the invention in that the space is substantially toroidal and surrounds the cylindrical seat, the outlet opening of the cylindrical seat being disposed so as to force the air leaving it to flow circumferentially through the space so as to facilitate the separation of the oil by centrifugal action and to flow over and cool the outer surface of the cylindrical seat.

The invention also provides for the making of the circumferential wall of the cylindrical seat from a ring of porous sintered material surrounded by an outer container, the space for separating and collecting the oil being constituted by the interspace between the exterior of the ring and the interior of the container, the overall purpose of which is to make the oil re-enter by capillary action, impregnate the ring and reduce the quantity of oil present in the pump when the pump is stopped, the outer space having the function of both an oil separator and a reserve of lubricating oil. In a preferred embodiment, the sintered material of the ring has a porosity such that the re-entry of the oil into the pump occurs not only by capillary action but also as a result of the pressure difference existing between the exterior of the ring, which is subject to the delivery pressure, and the zone within the ring close to the intake aperture, where the pressure is close to that of the inducted air. This embodiment also envisages the provision of a spiral partition outside the seat ring, which forces the air leaving the pump to effect several revolutions around the ring itself before leaving the pump, in order to increase the separation of the oil from the air. With this arrangement, it the pump remains inactive for a long period, for example, at least 24 hours, all the oil retained in the space outside the ring re-enters the pump. In normal operation, however, when the periods of stoppage are several hours at most, the oil does not succeed in passing into the seat except in neglibile quantities, while the ring of the seat is kept impregnated with oil. Thus, a further reduction in the power absorbed by the electric motor and more consistent operation is achieved.

Figure 2:
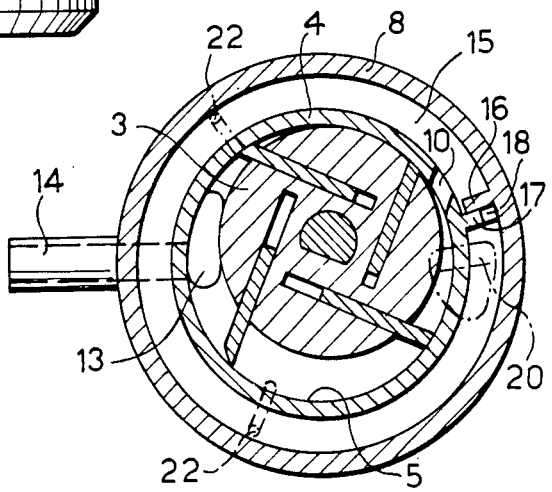
Figure 3:
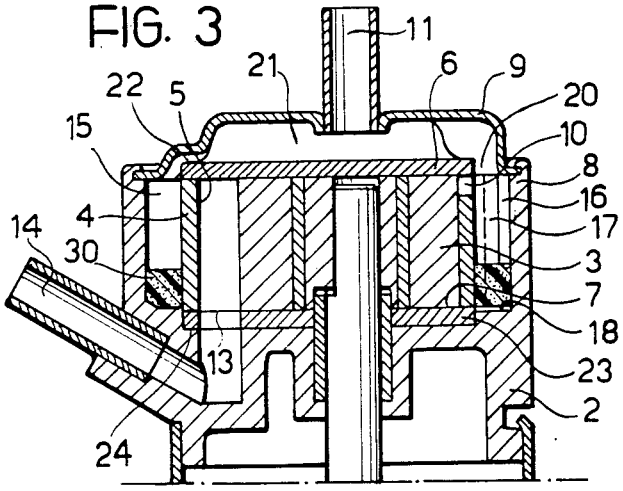
Figure 4:
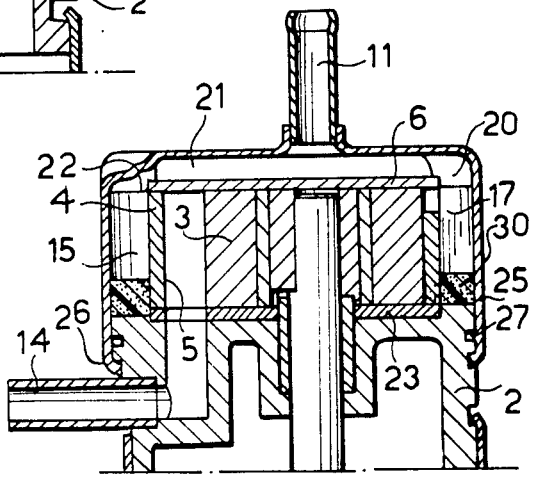
Figure 6:
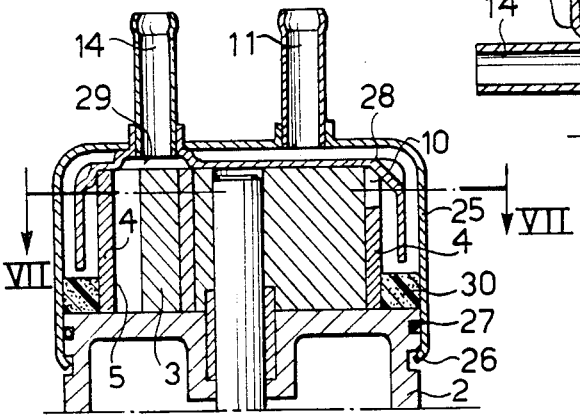
Figure 5:
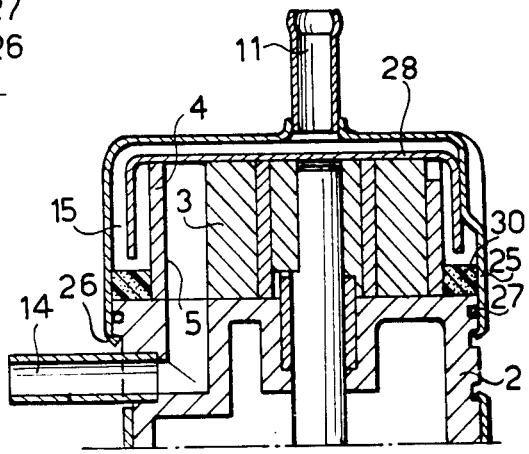
Figure 7:
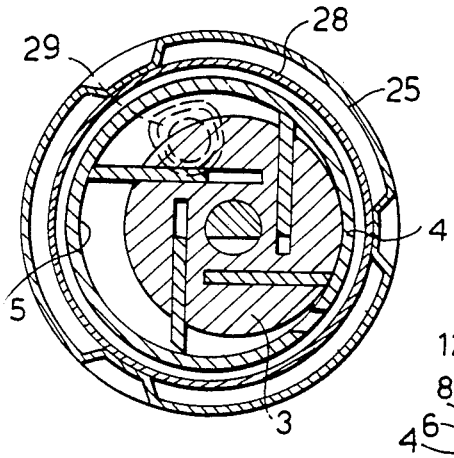
Figure 11:
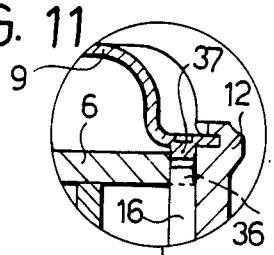
Figure 8:
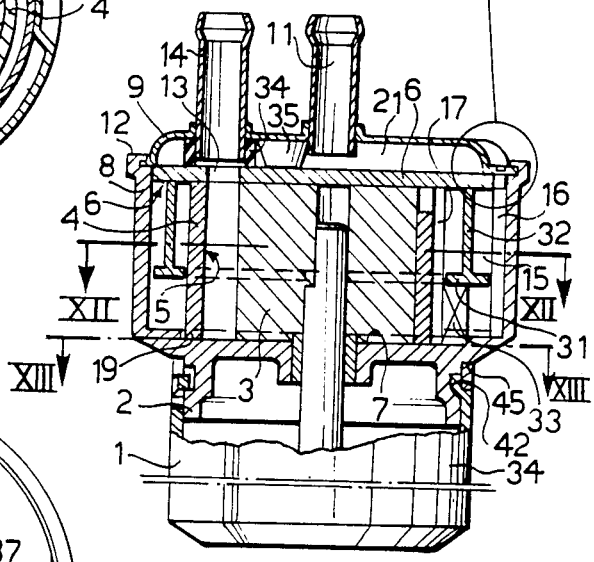
Figure 9:
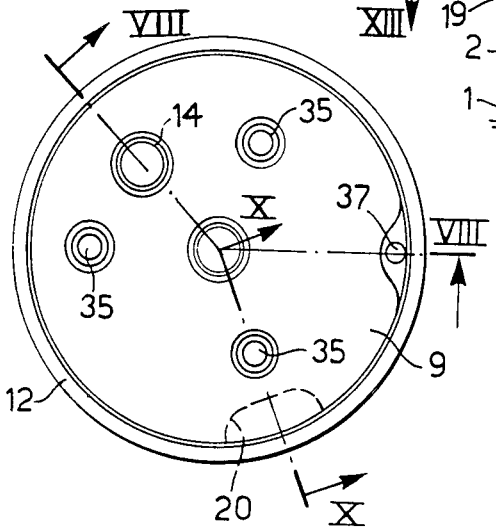
Figure 10:
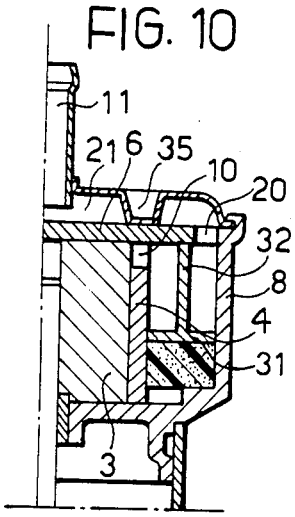
Figure 12:
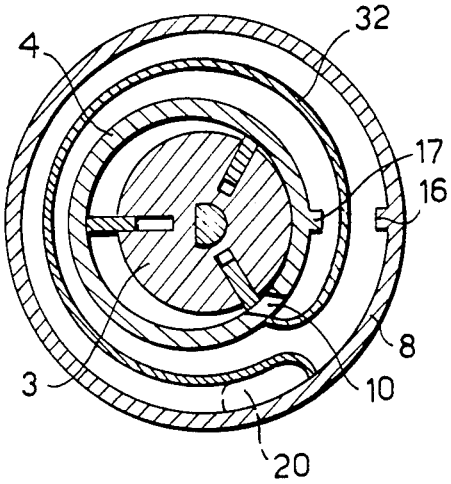
Figure 13:
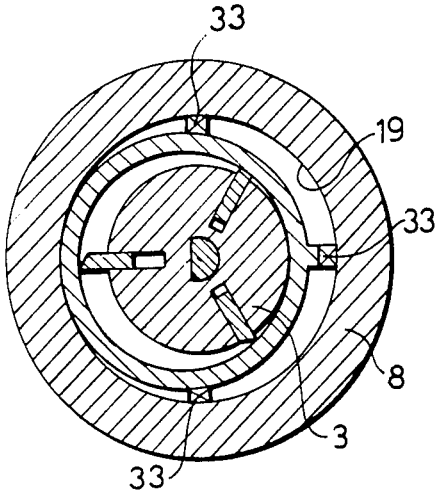
Figure 14:
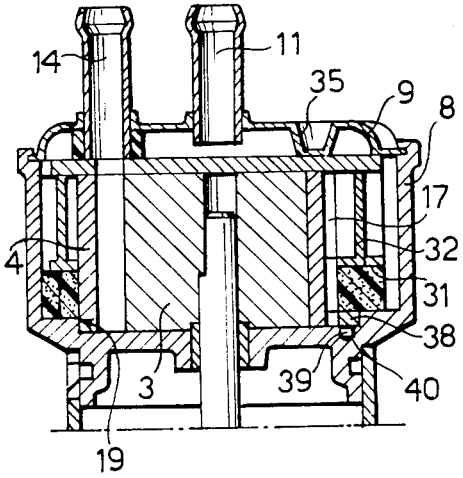
Figure 15:
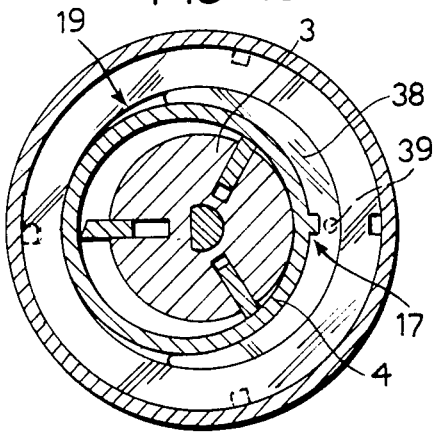
Figure 16:
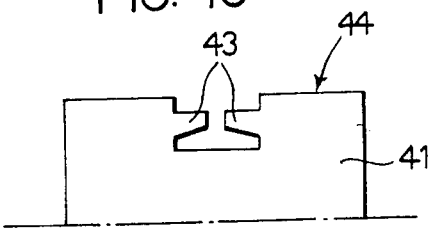
Figure 17:
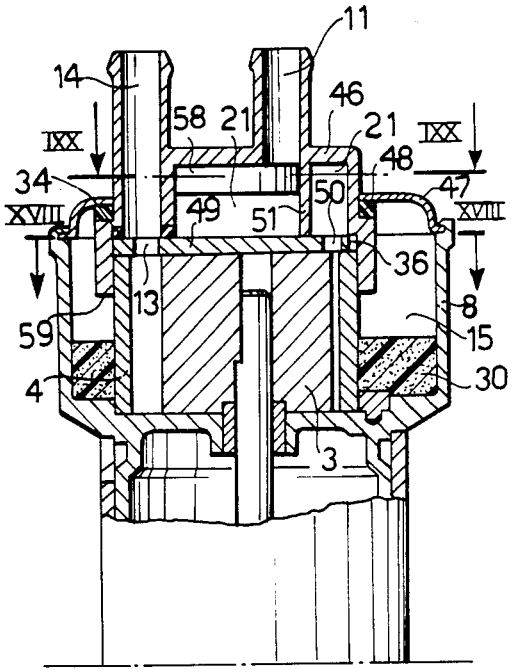
Figure 18:
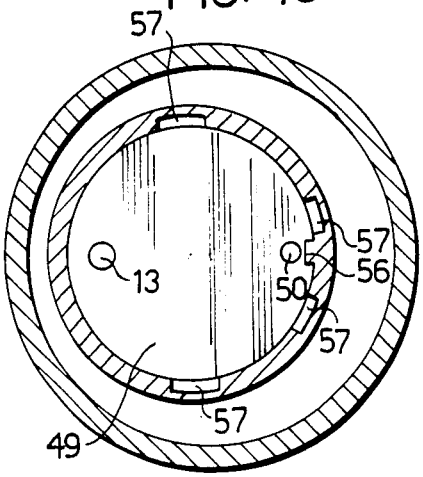
Figure 19:
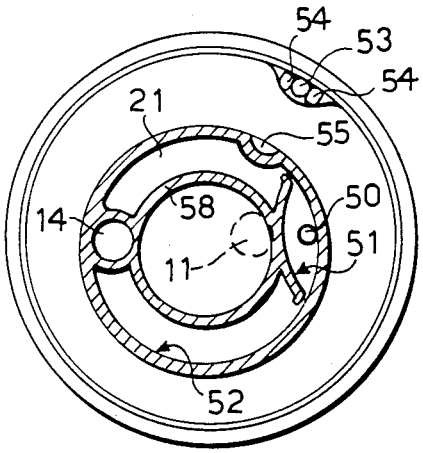
Figure 20:
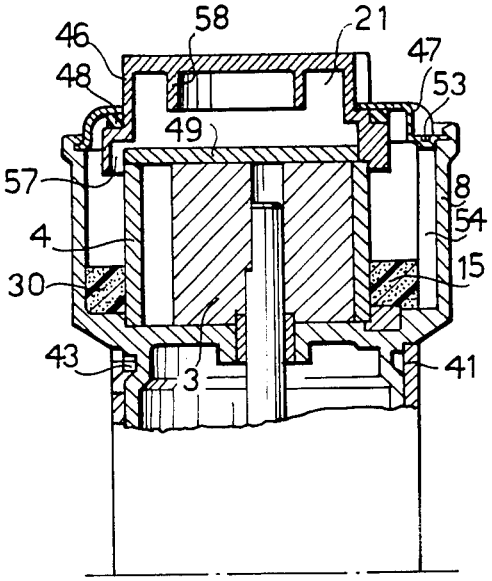

The invention will now be described below with reference to the appended drawings, in which:

FIG. 1 shows a pump in which the container is formed directly by the support of the electric motor, FIG. 2 is a section taken on the line II—II of FIG. 1, FIG. 3 is a variant of this solution with a plate interposed between the seat ring and the body of the pump, FIG. 4 is a solution with a sheet metal container, FIG. 5 shows a solution in which the plate is cup-shaped so as to force the air to flow out over the outer surface of the ring, FIG. 6 shows a solution of the type in FIG. 5, in which the intake opening is formed in the upper closure plate, FIG. 7 is a section taken on the line VII—VII of FIG. 6, in which the position of the outlet opening is indicated, FIG. 8 is a section of a further embodiment of the invention, taken on the line VIII—VIII of FIG. 9, FIG. 9 is a plan view of the pump, FIG. 10 is a section taken on the line X—X of FIG. 9, illustrating a detail of the air passage from the lower to the upper chamber, FIG. 11 is a detail of the device for orienting the plate and the cover relative to the container, FIG. 12 is a section taken on the line XII—XII of FIG. 8, in which the partition which facilitates the oil separation is visible, FIG. 13 is a section taken on the line XIII—XIII of FIG. 8, showing the manner in which the positioning of the ring relative to the support of the pump is achieved, FIGS. 14 and 15 show a different solution for the positioning of the ring, FIG. 16 shows a possible solution for the fixing of the casing of the motor to the support for the pump, FIG. 17 shows a solution in which the oil separation chamber is separated from the collecting chamber, FIGS. 18 and 19 are sections taken on the respective lines XVIII and IXX in FIG. 17, FIG. 20 is a different section of the solution of FIG. 17.

In the drawings details having the same function are indicated by the same reference numerals.

With reference to FIG. 1, an electric motor is indicated 1, its support 2, the pump rotor 3, the ring 4 in which is formed the circular seat 5, the upper closure plate 6, the support part 8 which forms a container for the ring 4, and a sheet metal cap 9 provided with the outlet union 11. The cap 9 is fixed to the container 8 by upsetting of the edge 12 and clamping of the closure plate 6 against the ring 4 and of the latter against the wall 7 of the support 2. An intake opening 13 is formed in the support 2 and communicates with the intake duct 14. The ring 4 has the outlet opening 10 located so as to direct the outlet air-flow tangentially to the inner wall of the container 8 (in an anti-clockwise sense with reference to FIG. 2). Immediately upstream of the outlet opening with respect to the sense of rotation, the container has a cast tab 16 which, in cooperation with the tab 17 of the ring 4, closes the section of the interspace 15 between the ring 4 and the container 8. The tab 17 also engages a groove 18 formed in the periphery of the bottom of the container 8 in correspondence with the assembly seat 19, ensuring the correct positioning of the outlet opening of the ring. The arrangement is shown more clearly in FIG. 2, together with the plan position of the intake opening 13. Between the closure plate 6 and the cap is a space 21 which communicates with the interspace 15 through the passage 20, the position of which is also indicated in broken outline in FIG. 2.

The operation of the system is as follows: the air leaving the outlet opening 10 effects a complete turn through the entire interspace to reach the aperture 20. In this complete turn, as a result of the centrifugal force, the entrained oil is separated from the air and deposited on the inner surface of the container 8 to run down and collect in the bottom of the interspace 15. The air which has already lost most of its oil passes into the space 21 and continues to circulate in a free vortex, depositing the remaining oil still present; it then leaves the pump through the outlet connector 11. The oil separated in the chamber 21 returns to the interspace 15 either through the opening 20 or through small channels which are press-formed in the cap 9 and also indicated in broken outline in FIG. 2. The oil which collects at the bottom of the interspace 15 keeps the ring 4 impregnated by capillary action and, when the pump is stopped, also re-enters the pump, albeit extremely slowly. The quantity which succeeds in entering the pump between one operation and the next, however, is very limited so that the pump nearly always operates without oil but with well-lubricated sliding surfaces. The oil which collects at the bottom of the intake opening and the union 14 is entrained by the air at the beginning of each new operating cycle and put back into circulation.

FIG. 3 shows the same solution as FIG. 2, in which a plate 23 of a different material from the support, with better wear-resistance characteristics, is interposed between the ring 4 and the support 2. In this case, the shape of the support may be varied, for example, so as to limit the tool-working of the sole periphery 24 at the bottom of the container, as indicated in the same drawing, and also to avoid the need for a high degree of surface finishing.

FIG. 4 shows a pump according to the invention, in which the collector is formed by a pressed sheet metal bell 25 which is fixed to the support 2 by squashing of the edge 26 of the bell itself. A rubber ring 27 acts as a seal both for pressurised air and for the oil collected in the interspace. The tab 17 of the ring 4 is longer in this case and itself closes the section of the interspace. The other components of the device and its operation are identical that of FIG. 3.

FIG. 5 differs from FIG. 4 in that a plate 28 is provided which is not flat but is also bell-shaped so as to force the air to flow over the outside of the ring 4.

FIG. 6 shows a solution of the type shown in FIGS. 4 and 5, in which the intake opening 29 is formed in the closure bell 28 and has a shape also indicated in FIG. 7 in broken outline.

In order to avoid the escape of oil when the pump is moved, it may be useful to insert a layer of absorbent material 30 in the bottom of the interspace 15 in all solutions, in order to soak up the oil collected in the interspace and gradually yield it to the ring.

From tests carried out it has been possible to ascertain that, by making the seat ring 4 of material with an adequate porosity, the re-entry of the oil into the ring from the collecting reservoir located around the ring itself occurs not only by capillary action when the motor is stopped, but also in operation as a result of the pressure difference existing between the outside of the ring, which is subject to the delivery pressure, and its interior in the zone close to the intake opening, where the pressure is close to that of the inducted air.

FIGS. 8 to 13 show a solution of a pump which operates on the same principle as that of FIG. 1, to which the following improvements have been added.

An annular baffle 31 (see FIG. 8) is added to prevent direct contact between the air leaving the pump, which forms a vortex around the seat ring 4, and the oil collected beneath the baffle 31, so as to avoid entrainment of the oil by the air.

A spiral partition 32 (see FIGS. 8 and 12) formed in the baffle itself is added which forces the air leaving the aperture 10 (FIG. 12) to effect two revolutions around the ring 4 before passing into the upper chamber 21 through the aperture 20 (FIG. 10) and from the chamber 21 to the outlet.

The baffle 31 is provided with three support tabs 33 (see FIGS. 8 and 13) which have a dual function, that is, one of maintaining the baffle 31 at the required height and one of positioning the seat ring 4 with the required eccentricity. Thus, it is possible to work the plane 7, which acts as the lower end face of the pump chamber, concentrically with the axis of the rotor and the electric motor, with considerable constructional simplification.

The intake duct 14, as in the embodiment of FIG. 6, has been provided on the cover 9 (see FIG. 8). This considerably simplifies the support 2 and reduces its dimensions. The duct 14 passes through the chamber 21 and the seal between its end section and the intake opening 13 with which the plate 6 is provided is ensured by a rubber washer 34 held in position by the delivery pressure present in the outlet chamber 21. The plate 6 (FIG. 8) is pressed against the ring 4 and the sheet metal cover 9 by means of three bosses 35, also visible in FIG. 9.

The positioning of the various elements indicated in FIG. 12 in a rotary sense is achieved by positioning the baffle with respect to the ring 4 by means of the rib 17 on the outside of the ring 4 itself and with reference to the container 8 by means of the rib 16 formed on the inside of the container 8 itself.

The positioning of the plate 6 and of the cover 9 relative to the container (see FIG. 11) is achieved by means of a notch 36 on the plate 6, which engages the rib 16 of the container, and by the boss 37 which engages the notch 36 in the plate 6 (see FIG. 9), respectively. A clearance is provided between the periphery of the plate 6 and the wall 8, to allow oil to return to the chamber 15. A clearance is also provided between the baffle 31 and the wall 8 as well as between the baffle 31 and the ring 4, for oil to return to the bottom of the chamber 15.

FIGS. 14 and 15 show a different system for positioning the ring 4 with the required eccentricity. A half-moon-shaped block 38 is inserted between the cylindrical surface 19 and the exterior of the ring 4 so as to force the ring 4 into the position with the required eccentricity relative to the support.

The block 38 has a small pin 39 beneath it which engages in a hole 40 formed in the bottom of the container.

The positioning of the ring 4 in the rotary sense is ensured by the rib 17 on the outside of the ring 4.

In FIG. 16, as well as FIG. 8, a possible solution for the fixing of the electric motor to the support 2 of the pump is shown. Two or more recesses of the shape indicated in FIG. 16 are formed in the sheet metal casing 41 of the motor. A groove 42 (FIG. 8) is formed in the pump support and is of trapezoidal form, as indicated in FIG. 16. Squashing of the tabs 43 into the groove 42 causes the tabs 43 themselves to be forced against the inclined surface of the groove 42 and hence forces the end edge 44 of the casing 41 of the motor against its bearing surface 45 on the support 2 of the pump.

FIGS. 17 to 20 show a pump solution in which the functions of separation and collection of the oil are assumed by the upper chamber 21 and the lower interspace 15, respectively.

The chamber 21 is formed in a housing 46 which is preferably of plastics material and fixed to the container 8 by means of the sheet metal cap 47, with the interposition of the rubber sealing ring 48.

Between the housing 46 and the seat ring 4 is a circular plate 49 which constitutes the upper closure wall of the seat of the pump, and into which the intake opening 13 and the outlet opening 50 open. The interior 21 of the housing 46 is provided with a baffle 51 (see FIG. 19) close to the outlet opening 50, which forces the air coming from the opening 50 and directed to the outlet union 11 to flow over the internal walls 52 of the chamber 21 to cause the oil entrained by the air to be separated by centrifugal action.

On the other hand, a first separation of the oil from the air is achieved by the fact that the air leaving the outlet opening 50 hits the upper wall of the housing and good part of the oil adheres to this wall.

The correct positioning of the various elements in a rotary sense is ensured in the manner described below:

the sheet metal cap 47 relative to the container 8 by means of the boss 53 which engages between the two ribs 54 of the container 8 (see FIGS. 19 and 20), the plastic housing 46 relative to the cap 47 by means of a semi-circular tooth 55 which engages in a suitable recess formed in the housing 46, the circular plate 49 relative to the housing 46 by means of the tooth 56 (FIGS. 17 and 18) formed on the housing 46 and engaging in a corresponding seat formed in the plate 49.

The oil which collects in the chamber 21 returns to the collecting reservoir 15 through the passages 57 (FIGS. 18 and 20) formed in the housing 46 itself.

In order to prevent the oil which has been separated from the air and deposited on the upper wall of the separation chamber 21 from being entrained towards the outlet 11, a substantially cylindrical baffle 58 with a height of about half the height of the chamber is added. Its function is to prevent oil deposited on the upper wall of the separation chamber 21 from being entrained by the air, sliding along the upper wall, and entering the outlet opening.

The circular plate 49 which constitutes the upper closure wall of the pump may be made from any ferrous metal or aluminium.

It is also possible to make it from sintered material whereby the lubricating effects on the contact between the rotor and the vanes on the one hand and the plate on the other are improved as a result of the passage of oil during operation of the motor, due to the pressure difference existing between the chamber 21, which is subject to the delivery pressure, and the zone underlying the pump close to the intake zone, where the pressure is that of the inducted air.

With reference to FIG. 17, the circumferential wall of the housing 46 extends axially through a distance sufficient to ensure that, whenever the device is mounted upside down with respect to the position illustrated in FIG. 17, the level of the oil in the chamber 15 (in this case, the oil collects on the bottom of the cap 47) is in any event maintained beneath the end edge 59 so as to avoid the risk of oil leaking into the chamber 21. Similarly, the proportioning of the parts must be such that, whenever the device is mounted with the axis of the pump horizontal, the level of the oil (which collects on a zone of the wall 8) does not reach the internal diameter of the edge 59.

Naturally, the principle of the invention remaining the same, the constructional details and forms of embodiment may be varied widely with respect to those described and illustrated purely by way of example, without thereby departing from the scope of the present invention.

We claim:

1. A pneumatic vane pump comprising a substantially cylindrical housing, a cylindrical seat concentrically mounted within said housing and defining an oil reservoir chamber between said cylindrical seat and said housing, an electric driving motor mounted in said housing, a rotor coupled to said motor and mounted within said cylindrical seat for rotation about an axis eccentrically disposed relative to said cylindrical seat, said rotor having a plurality of recesses each having a vane movably mounted therein for contact with said cylindrical seat, a plate mounted on one end of said cylindrical seat and having inlet and outlet openings therethrough, cover means secured to said housing and having an end wall and a cylindrical wall defining a substantially cylindrical chamber between said cover means and said plate with said outlet opening disposed adjacent said cylindrical wall, said cover means having an outlet passage communicating the interior of said cylindrical chamber with the exterior thereof and an inlet passage extending through said cover means and communicating said inlet opening with the exterior of said cover means, partition means secured to said cover means adjacent said outlet hole in said plate and spaced from said cylindrical wall of said cover means for forcing air from the outlet opening over the cylindrical wall of the chamber before entering said outlet passage for depositing transported oil on said cylindrical wall of the cylindrical chamber by centrifugal action.

2. A pneumatic vane pump as set forth in claim 1 further comprising a substantially cylindrical baffle depending from said end wall of said cover means concentric with the cylindrical wall of said cover means between said outlet passage and said cylindrical wall to prevent oil deposited on the end wall of the separating chamber from being entrained in the air passing outwardly through said outlet passage.

* * * * *